US012253326B1

(12) United States Patent
Burgess

(10) Patent No.: US 12,253,326 B1
(45) Date of Patent: Mar. 18, 2025

(54) SPENT BRASS COLLECTION CONTAINER

(71) Applicant: Donn Burgess, Halifax, MA (US)

(72) Inventor: Donn Burgess, Halifax, MA (US)

( * ) Notice: Subject to any disclaimer, the term of this patent is extended or adjusted under 35 U.S.C. 154(b) by 113 days.

(21) Appl. No.: 18/117,014

(22) Filed: Mar. 3, 2023

(51) Int. Cl.
*F41A 9/60* (2006.01)

(52) U.S. Cl.
CPC ..... *F41A 9/60* (2013.01)

(58) Field of Classification Search
CPC ..... B65D 83/04; B65D 83/06; F41A 9/60
USPC ..... 206/528–510, 3; 209/509
See application file for complete search history.

(56) References Cited

U.S. PATENT DOCUMENTS 970,025 A * 9/1910 Druliner ..... A47B 49/004 312/305
1,351,251 A * 8/1920 Jewell ..... G01F 11/18 312/301
2,774,470 A * 12/1956 John ..... B65D 83/0409 221/202
3,313,451 A * 4/1967 Rhindress ..... A47J 39/02 221/256
4,494,804 A * 1/1985 O'Keeffe ..... B25H 3/02 312/211
4,763,810 A * 8/1988 Christiansen ..... A61J 7/0481 221/3
5,174,471 A * 12/1992 Kozlowski ..... B65D 83/0409 221/202
6,375,289 B1 * 4/2002 Yemini ..... B25H 3/028 312/902
6,733,095 B1 * 5/2004 Rieb ..... A61J 1/03 312/138.1
6,948,634 B2 * 9/2005 Evans ..... B65D 43/021 221/202
7,857,147 B2 * 12/2010 Mulaw ..... A47L 19/04 220/572
9,010,010 B2 4/2015 Dreiband
9,366,491 B1 6/2016 Baxley
10,342,741 B1 * 7/2019 Dickey ..... G07F 17/0092
10,343,836 B2 * 7/2019 Li ..... B65D 85/60
10,351,333 B2 * 7/2019 Li ..... B65D 85/60
2004/0097181 A1 * 5/2004 Perkitny ..... G07D 9/065 453/3
2009/0095644 A1 * 4/2009 Brinsmead ..... B44D 3/125 206/209

* cited by examiner

*Primary Examiner* — Chun Hoi Cheung
(74) *Attorney, Agent, or Firm* — Sanchelima & Associates, P.A.; Jesus Sanchelima; Christian Sanchelima

(57) ABSTRACT

A spent brass collection container including a housing assembly, a funnel assembly, and a compartment assembly. The housing is a container with an opening in a front side thereof, wherein the housing further includes a base for stabilization. The funnel assembly includes slanted guidelines inside the housing that conveys towards a neck, wherein the guidelines in conjunction with the neck creates a funnel-shaped portion inside the housing. The compartment assembly includes a drawer at a bottom portion of the interior of the housing, where the drawer slides in and slides out from a portion of the neck through a second opening of the housing. The elements of the foregoing are made of a heat resistant material that are adapted to receive cartridge cases or the like to collect them in the drawer to dispose them when the user may consider appropriate.

2 Claims, 2 Drawing Sheets

SPENT BRASS COLLECTION CONTAINER

BACKGROUND OF THE INVENTION

1. Field of the Invention

The present invention relates to a container and, more particularly, to a spent brass collection container that includes a funnel-shaped portion inside the container where the cartridge cases slide towards a drawer for easier disposal.

2. Description of the Related Art

Several designs for spent brass collection containers have been designed in the past. None of them, however, include a container which includes a funnel-shaped portion where the cartridge cases are guided towards a drawer to collect them, thereby the user may empty the drawer, keeping the ground clean.

Applicant believes that a related reference corresponds to U.S. Pat. No. 9,366,491 issued for brass catching device. Applicant believes that another related reference corresponds to U.S. Pat. No. 9,010,010 issued for firearm magazine catch apparatus. None of these references, however, teach of a container with a front opening and a funnel-shaped interior, wherein the bottom of the interior funnel-shaped portion includes a drain with a drainage catcher under the drain.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a device that keeps the ground free of cartridge cases while practicing shooting.

It is another object of this invention to provide a device that collects the cartridge cases into a drawer to facilitate the cartridge cases disposal.

It is still another object of the present invention to provide a device that saves time by collecting the cartridge cases in an easy way.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
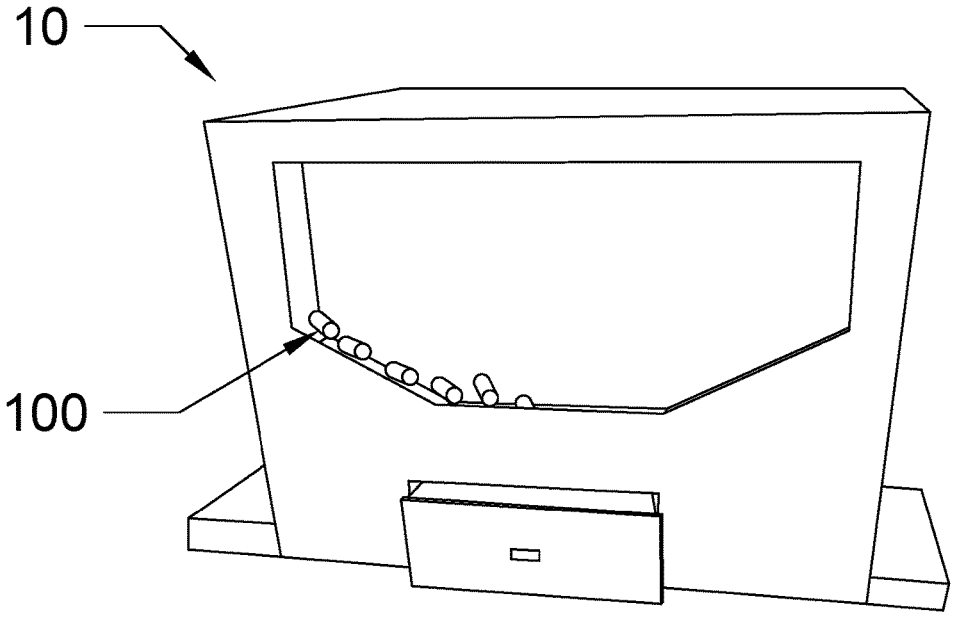
FIG. 1 represents an operational view of an exemplary embodiment of the present invention 10, wherein the cartridge cases 100 may be stored inside the drawer 62.

Referring now to the drawings, where the present invention is generally referred to with numeral 10, it can be observed that it basically includes a housing assembly 20, a funnel assembly 40, compartment assembly 60 and various exemplary embodiments (100) thereof. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Figure 2:
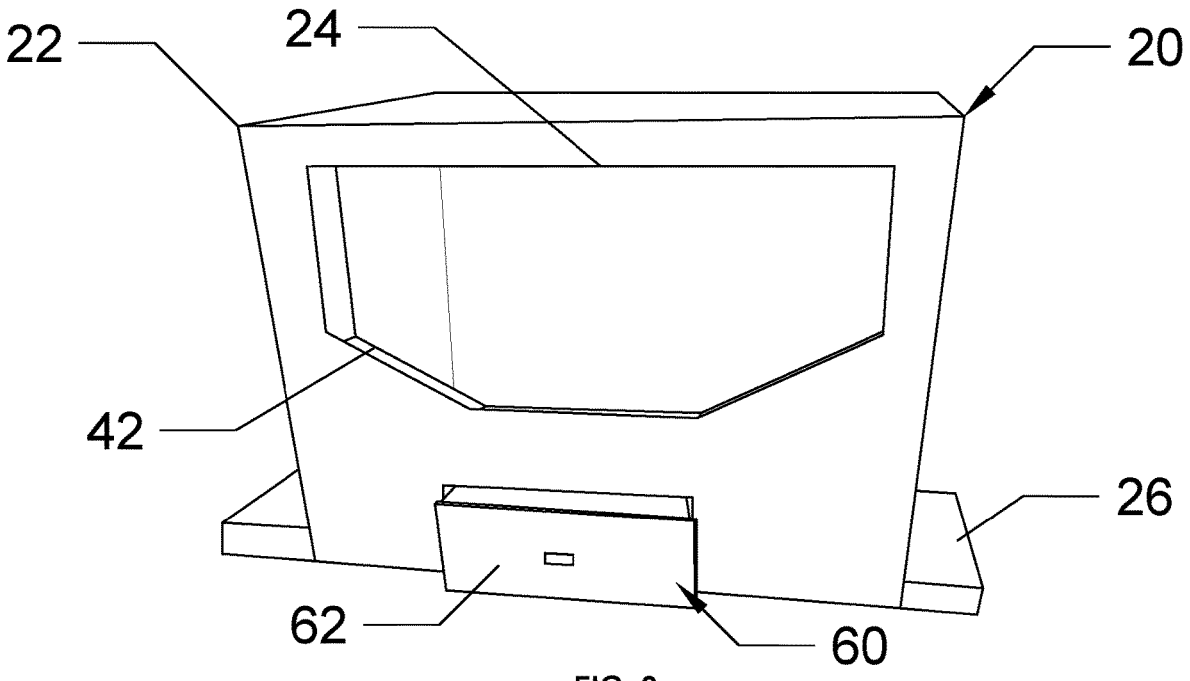
FIG. 2 shows an isometric view of the housing assembly 20, wherein the housing 22 includes an opening 24 and a base 26 to provide stabilization.

Housing assembly 20 includes a housing 22, an opening 24, and a base 26. In an exemplary embodiment, the housing 22 may be a cuboid shaped housing with a hollow body, nevertheless a cube shaped housing, a spherical shaped housing, a regular shape, or an irregular shape may be considered for the housing 22. In a suitable embodiment, the housing 22 may be made of aluminum, carton material, steel, wood, or any other suitable heat resistance material that prevents from being damaged when contacted with the cartridge cases 100. In a preferred embodiment, the housing 22 may have the opening 24 in a front side thereof, wherein the opening 22 may be an inverted trapezoid shaped aperture that accesses to the interior of the housing 22. Nonetheless, it should be considered that a circular shaped aperture, a quadrilateral shaped aperture, an oval shape aperture, and a regular or irregular shape may be suitable for the opening 24. In one embodiment, the opening 24 may be proximal to the top edge of the front side of the housing 22. As FIG. 2 depicts. Nonetheless, in a suitable variation, the opening 22 may be placed on the laterals, the top side, or the rear side of the housing 22. In other embodiment, the base 26 may be a rectangular plank on the bottom side of the housing 22. It should be considered that the base 26 may be lateral supports or a lateral flange attached at the bottom side of the laterals of the housing 22. As FIG. 2 illustrates. The base 26 may be made of the same material as the housing 22 such as aluminum, steel, plastic, or any other suitable material, although a different material that allows the housing 22 to be steady on a surface should be considered. In a suitable variation, the housing 22 may be made of an impact resistance material and the interior thereof may be covered by a heat resistance material.

Figure 3:
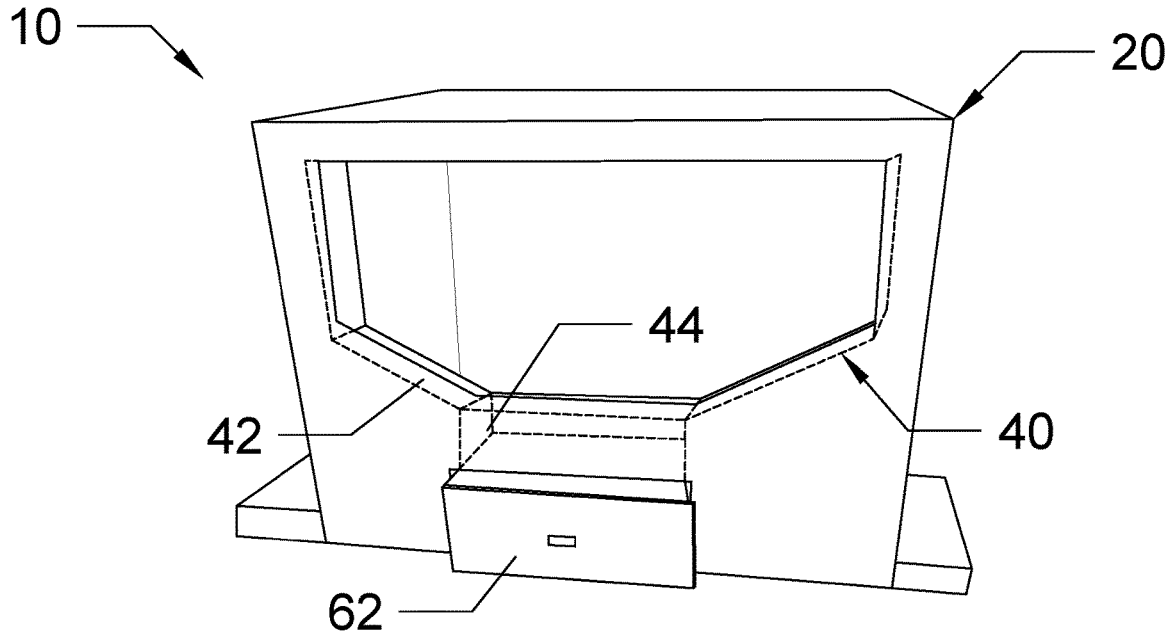
FIG. 3 illustrates an operational see-through view of the present invention 10, wherein the housing 22 includes guidelines 42 and a neck 44 that conforms a funnel-shaped portion where the cartridge cases 100 slides towards the drawer 62.

Funnel assembly includes guidelines 42 and a neck 44. In an exemplary embodiment, the guidelines 42 are slanted supports attached at the interior of the housing 22 by means of the lateral sides, the rear side, and the front side, thereby creating a channel or neck 22 in a center portion of the interior of said housing 22. As best depicted in FIG. 3. In a suitable embodiment, the slanted configuration of the guidelines 42 may guide the cartridge cases 100 towards the neck 44 when placed inside the housing 22, as FIG. 1 represents, thereby the guidelines 42 may be made of a heat resistant material such as steel, wood, aluminum, or any other suitable material. Nonetheless, it should be considered that the guidelines 42 may be made of a combination of a hard material with a heat resistance material. In a preferred embodiment, the neck 44 is a narrow portion at the interior of the housing 22, wherein said neck 44 or channel in conjunction with the guidelines 42 creates a funnel shaped portion, as FIG. 3 shows, that guides the cartridge cases 100 to the bottom of the neck 44. The neck 44 may have a width as the bottom base of the opening 24, nonetheless, a wide top portion of the neck 44 that narrows at the bottom should be considered. In a preferred embodiment, the neck 44 may be made of a heat resistant material such as steel, wood, aluminum, or any other suitable material. Nonetheless, it should be considered that the neck 44 may be made of a combination of a hard material with a heat resistance material.

Figure 4:
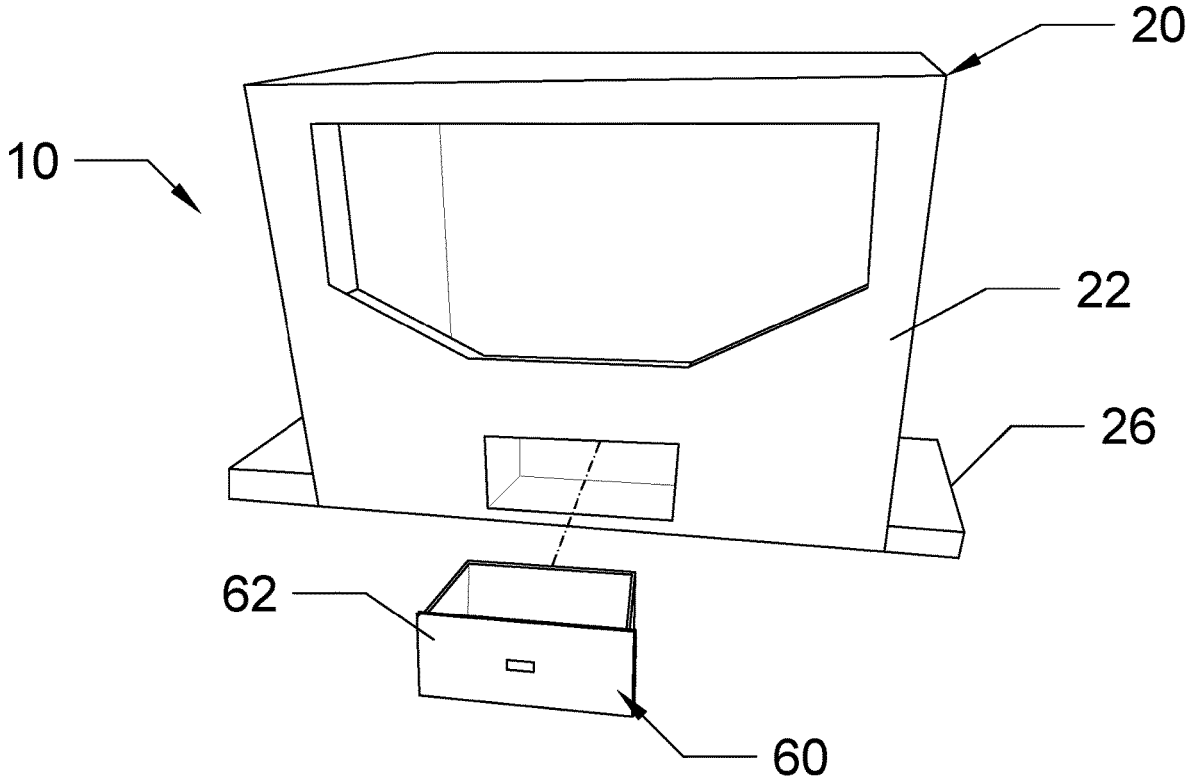
FIG. 4 is a representation of an exploded view of the present invention 10, wherein the drawer 62 may be coupled and uncoupled from the housing 22.

Compartment assembly 60 includes a drawer 62. In an exemplary embodiment, the housing 22 further includes a second opening where the drawer 62 is placed, wherein the drawer 62 may be a box-shaped container inside the housing 22. Referring to FIG. 4, the drawer 62 may be inserted into the housing through the second opening, thereby a portion of the drawer 62 may occupy a portion of the neck 44. As further illustrated in FIG. 3. In a suitable embodiment the drawer 62 may be a drawer well known in the art, wherein the receiving portion of the drawer 62 may be made/cover of a heat resistance material.

Referring to the figures, and more particularly to FIG. 1, the housing is adapted to collect the cartridge cases 100 by means of the drawer 62, wherein the funnel assembly 40 may guide the cartridge cases 100 to the drawer 62, thereby the user may collect the cartridge cases or the like inside the drawer to be dispose when the user may consider appropriate, thus keeping the ground clean.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A spent brass collection container, comprising:

a housing assembly including a housing, an opening, and a base, wherein the housing is a container with said opening in a side thereof, wherein said base has lateral flanges attached at the bottom side of said housing to provide stabilization, said housing is made of an impact resistant material with a heat resistant interior, said opening is an inverted trapezoid aperture placed proximal to a top edge of said side of said housing;

a funnel assembly including guidelines and a neck, wherein said guidelines are ramps placed at the interior of said housing, said neck is a channel in a center portion of said interior of said housing, said guidelines, said neck and said drawer are made of a heat resistant material, wherein said guidelines are attached to interior of said housing by means of the laterals, a front side, and a rear side of said housing, said slanted supports ramps conveys towards said neck; and a compartment assembly including a drawer, wherein said drawer is a container removably attachable to said housing, said container further includes a second opening where said drawer is coupled, wherein said drawer is a box-shaped container that slides in and slides out from said neck through said second opening; wherein said housing receives cartridge cases, said cartridge cases are guided by the funnel assembly to the drawer.

2. A spent brass collection container, consisting of:

a housing assembly including a housing, an opening, and a base, wherein the housing is a container with said opening in a side thereof, wherein said base has lateral flanges attached at the bottom side of said housing to provide stabilization, said housing is made of an impact resistant material with a heat resistant interior, said opening is an inverted trapezoid aperture placed proximal to a top edge of said side of said housing;

a funnel assembly including guidelines and a neck, wherein said guidelines are ramps placed at the interior of said housing, said neck is a channel in a center portion of said interior of said housing, said guidelines, said neck and said drawer are made of a heat resistant material, wherein said guidelines are attached to interior of said housing by means of the laterals, a front side, and a rear side of said housing, said ramps conveys towards said neck, said neck in conjunction with said guidelines creates a funnel shaped portion; and a compartment assembly including a drawer, wherein said drawer is a container removably attachable to said housing, said container further includes a second opening where said drawer is coupled, wherein said drawer is a box-shaped container that slides in and slides out from said neck through said second opening: wherein said housing receives cartridge cases, said cartridge cases are guided by the funnel assembly to the drawer.

* * * * *